US010957258B2

(12) United States Patent
Ye et al.

(10) Patent No.: US 10,957,258 B2
(45) Date of Patent: Mar. 23, 2021

(54) DISPLAY DEVICE AND ELECTRONIC DEVICE HAVING THE SAME

(71) Applicant: Samsung Display Co., Ltd., Yongin-si (KR)

(72) Inventors: Byoung Dae Ye, Yongin-si (KR); Junwoo You, Seongnam-si (KR); Taeho Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/579,657

(22) Filed: Sep. 23, 2019

(65) Prior Publication Data

US 2020/0152125 A1 May 14, 2020

(30) Foreign Application Priority Data

Nov. 9, 2018 (KR) ..... 10-2018-0137446

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); *G09G 2310/0243* (2013.01); *G09G 2310/08* (2013.01); *G09G 2320/0233* (2013.01); *G09G 2330/028* (2013.01)

(58) Field of Classification Search
CPC .. G09G 3/3258; G09G 3/3291; G09G 3/3266; G09G 2320/0233; G09G 2310/0243; G09G 2330/028; G09G 2310/08; G09G 2300/0861; G09G 3/3233; G09G 2320/0295; G09G 2300/0819; G09G 2300/0842; G09G 2320/043
See application file for complete search history.

(56) References Cited

U.S. PATENT DOCUMENTS

2016/0163265 A1* 6/2016 Yang ..... G09G 3/3233 345/690
2018/0033374 A1* 2/2018 Jeong ..... G09G 3/3618
2018/0061314 A1 3/2018 Kim
2018/0082634 A1* 3/2018 Wang ..... G09G 3/3233
2018/0190192 A1* 7/2018 Kwon ..... G09G 3/3233

FOREIGN PATENT DOCUMENTS

KR 10-0700846 B1 3/2007
KR 10-2009-0043303 A 5/2009
KR 10-2015-0012022 A 2/2015

* cited by examiner

*Primary Examiner* — Premal R Patel
(74) *Attorney, Agent, or Firm* — Lewis Roca Rothgerber Christie LLP

(57) ABSTRACT

A display device includes a display panel including a plurality of pixels that each include an organic light emitting diode and a driving element, the display panel being configured to display an image data on the pixels; a data driver configured to generate a data voltage corresponding to the image data; a compensation circuit configured to sense a driving current flowing through the pixels and to generate a compensation data voltage that compensates for a threshold voltage of the driving element based on the data voltage and the driving current; a scan driver configured to generate a first scan signal and a second scan signal provided to the pixels; and a timing controller configured to generate control signals that control the data driver and the scan driver.

18 Claims, 6 Drawing Sheets

DISPLAY DEVICE AND ELECTRONIC DEVICE HAVING THE SAME

CROSS-REFERENCE TO RELATED APPLICATION

The present application claims priority to and the benefit of Korean Patent Application No. 10-2018-0137446, filed on Nov. 9, 2018 in the Korean Intellectual Property Office (KIPO), the content of which is incorporated herein in its entirety by reference.

BACKGROUND

1. Field

Aspects of some example embodiments relate generally to a display device and an electronic device having the same.

2. Description of the Related Art

Recently, flat panel display (FPD) devices have been widely used as display devices for electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. OLED devices have been spotlighted as next-generation display devices because they have various characteristics such as a relatively wide viewing angle, a relatively rapid response speed, relatively low thickness, relatively low power consumption, etc.

Each pixels of an OLED device may include an organic light emitting diode and a pixel circuit that drives the organic light emitting diode. The pixel circuit may include a driving element that generates a driving current provided to the organic light emitting diode. As use time of the organic light emitting display device increases, the driving element may be degraded and a threshold voltage of the driving element may be changed. As the threshold voltage of the driving element is changed, the luminance of the pixel may decrease, which may reduce the perceived display quality of the OLED device.

The above information disclosed in this Background section is only for enhancement of understanding of the background and therefore it may contain information that does not constitute prior art.

SUMMARY

Aspects of some example embodiments may include a display device capable of improving display quality.

Aspects of some example embodiments may include an electronic device having a display device capable of improving display quality.

According to some example embodiments according to the present disclosure, a display device includes: a display panel including a plurality of pixel that includes an organic light emitting diode and a driving element, the display panel configured to display an image data on the pixels, a data driver configured to generate a data voltage corresponding to the image data, a compensation circuit configured to sense a driving current flowing through the pixels and generate a compensation data voltage that compensates for a threshold voltage of the driving element based on the data voltage and the driving current, a scan driver configured to generate a first scan signal and a second scan signal provided to the pixels, and a timing controller configured to generate control signals that control the data driver and the scan driver.

According to some example embodiments, the compensation circuit may include a sensing unit configured to sense the driving current and generate a sensing voltage corresponding to the driving current and a compensation data voltage generator configured to generate the compensation data voltage that compensates for the threshold voltage of the driving element based on the data voltage and the sensing voltage.

According to some example embodiments, the sensing unit may include a sensing resistor configured to sense the driving current and generate a first sensing voltage corresponding to the driving current and an amplifier configured to output a second sensing voltage by amplifying the first sensing voltage.

According to some example embodiments, the compensation voltage generator may include a comparator that compares the data voltage to the second sensing voltage and converts the data voltage to the compensation data voltage.

According to some example embodiments, the comparator may include a first input terminal configured to receive the data voltage, a second input terminal configured to receive the second sensing voltage, and an output terminal configured to output the compensation data voltage by comparing the data voltage and the second sensing voltage.

According to some example embodiments, the organic light emitting diode may include an anode electrode and a cathode electrode and the driving element may include a gate electrode coupled to a first node, a first electrode that receives a first power voltage, and a second electrode coupled to a second node.

According to some example embodiments, the scan driver may further generate a third scan signal provided to the pixels.

According to some example embodiments, each of the pixels further may include a first switching element including a gate electrode that receives the first scan signal, a first electrode coupled to the compensation data voltage generator, and a second electrode coupled to the first node, a second switching element including a gate electrode that receives the second scan signal, a first electrode coupled to the second node, and a second electrode coupled to the anode electrode of the organic light emitting diode, a third switching element including a gate electrode that receives the third scan signal, a first electrode coupled to the second node, and a second electrode coupled to the sensing unit, and a storage capacitor including a first electrode that receives the first power voltage and a second electrode coupled to the first node.

According to some example embodiments, the first switching element and the third switching element may turn on and the second switching element may turn off in a compensation period of the pixel.

According to some example embodiments, the first switching element and the second switching element may turn on, the third switching element may turn off, and the compensation data voltage is maintained in an emission period of the pixel.

According to some example embodiments, the second switching element may turn on, and the first switching element and the third switching element may turn off in an emission period of the pixel.

According to some example embodiments, each of the pixels may further include a first switching element including a gate electrode that receives the first scan signal, a first electrode coupled to the compensation data voltage generator, and a second electrode coupled to the first node, a second switching element including a gate electrode that receives the second scan signal, a first electrode coupled to the cathode electrode of the organic light emitting diode, and a second electrode coupled to the sensing unit, and a storage capacitor including a first electrode that receives the first power voltage and a second electrode coupled to the first node.

According to some example embodiments, the second switching element may turn on and the driving current may be sensed in an emission period of the pixel.

According to some example embodiments, the compensation circuit may be located in the data driver or coupled to the data driver.

According to some example embodiments of the present disclosure, an electronic device includes: a display device and a processor that controls the display device. The display device may include a display panel including a plurality of pixels that includes an organic light emitting diode and a driving element, the display panel configured to display an image data on the pixels, a data driver configured to generate a data voltage corresponding to the image data, a compensation circuit configured to sense a driving current flowing through the pixels and generate a compensation data voltage that compensates for a threshold voltage of the driving element based on the data voltage and the driving current, a scan driver configured to generate a first scan signal and a second scan signal provided to the pixels, and a timing controller configured to generate control signals that control the data driver and the scan driver.

According to some example embodiments, the compensation circuit may include a sensing unit configured to sense the driving current and generate a sensing voltage corresponding to the driving current and a compensation data voltage generator configured to generate a compensation data voltage that compensates for the threshold voltage of the driving element based on the data voltage and the sensing voltage.

According to some example embodiments, the sensing unit may include a sensing resistor configured to sense the driving current and generate a first sensing voltage corresponding to the driving current and an amplifier configured to output a second sensing voltage by amplifying the first sensing voltage. The compensation voltage generator may include a comparator that compares the data voltage to the second sensing voltage and converts the data voltage to the compensation data voltage.

According to some example embodiments, the organic light emitting diode may include an anode electrode and a cathode electrode and the driving element may include a gate electrode coupled to a first node, a first electrode that receives a first power voltage and a second electrode coupled to a second node.

According to some example embodiments, each of the pixels may further include a first switching element including a gate electrode that receives the first scan signal, a first electrode coupled to the compensation data voltage generator, and a second electrode coupled to the first node, a second switching element including a gate electrode that receives the second scan signal, a first electrode coupled to the second node, and a second electrode coupled to the anode electrode of the organic light emitting diode, a third switching element including a gate electrode that receives a third scan signal, a first electrode coupled to the second node, and a second electrode coupled to the sensing unit, and a storage capacitor including a first electrode that receives the first power voltage and a second electrode coupled to the first node.

According to some example embodiments, each of the pixels may further include a first switching element including a gate electrode that receives the first scan signal, a first electrode coupled to the compensation data voltage generator, and a second electrode coupled to the first node, a second switching element including a gate electrode that receives the second scan signal, a first electrode coupled to the cathode electrode of the organic light emitting diode, and a second electrode coupled to the sensing unit, and a storage capacitor including a first electrode that receives the first power voltage and a second electrode coupled to the first node.

Therefore, a display device according to some example embodiments may prevent or reduce instances of the luminance of the pixels of a display device being lowered due to a change in the threshold voltage of the driving element by including the compensation circuit coupled to the pixels having 4T1C structure or 3T1C structure to sense the driving current flowing through the pixels and generate the compensation data voltage that compensates for a threshold voltage of the driving element included in each of the pixels by comparing the data voltage and the driving current. Thus, the display quality of the display device may improve.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, aspects of some example embodiments of the present inventive concept will be explained in more detail with reference to the accompanying drawings.

Figure 1:
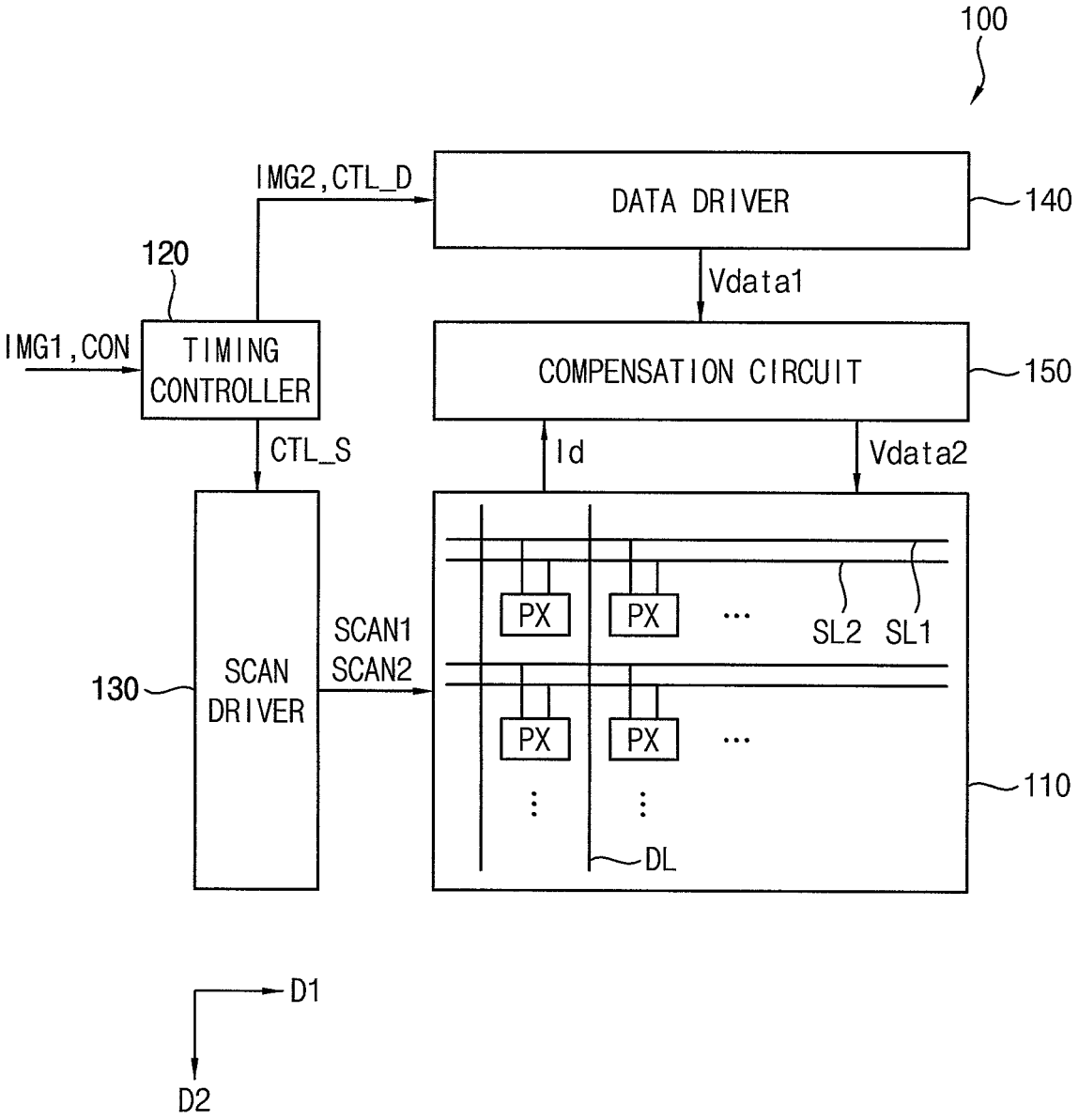
FIG. 1 is a block diagram illustrating a display device according to some example embodiments.
Figure 2:
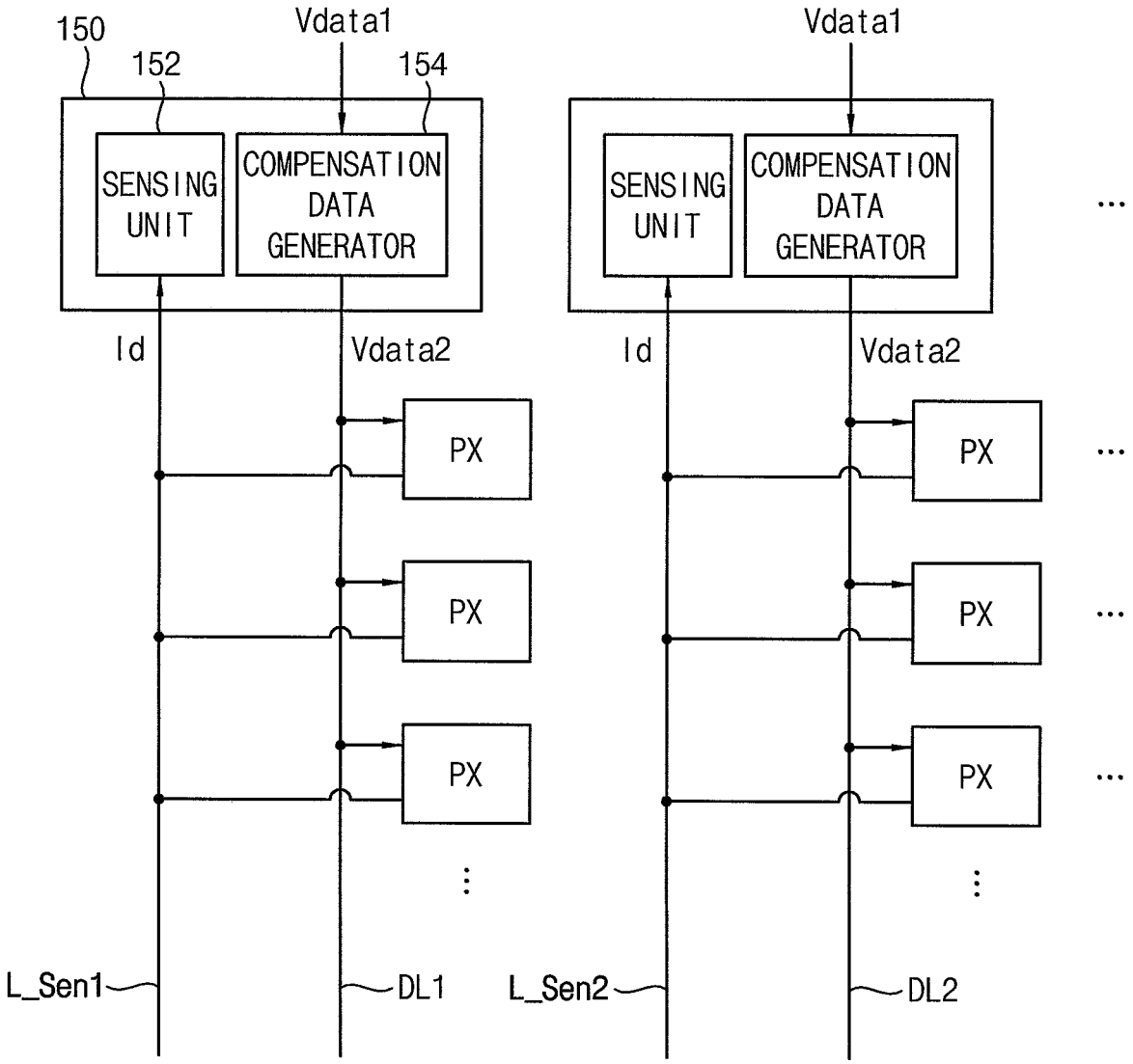
FIG. 2 is a diagram illustrating a compensation circuit and a pixel included in the display device of FIG. 1.

FIG. 1 is a block diagram illustrating a display device according to some example embodiments. FIG. 2 is a diagram illustrating a compensation circuit and a pixel included in the display device of FIG. 1.

Referring to FIG. 1, a display device 100 may include a display panel 110, a timing controller 120, a scan driver 130, a data driver 140, and a compensation circuit 150.

The display panel 110 may include a plurality of pixels PX that includes an organic light emitting diode and a driving element. The display panel 110 may include a plurality of scan lines SL1, SL2, and a plurality of data lines DL. Each of the pixels PX may be electrically coupled to each of the scan lines SL1, SL2, and the data lines DL. The scan lines SL1, SL2 may extend in a first direction D1 and be arranged in a second direction D2 perpendicular to the first direction D1. For example, a first scan line SL1 and a second scan line SL2 may be formed in the display panel 110.

Although the first scan line SL1 and the second scan line SL2 formed in the display panel 110 are described in FIG. 1, the number of the scan lines is not limited thereto. For example, a third scan line may be additionally formed in the display panel 110. The data lines DL may extend in the second direction D2 and be arranged in the first direction. The first direction D1 may be parallel with a long side of the display panel 110, and the second direction D2 may be parallel with a short side of the display panel 110. Each of the pixels PX may be formed in intersection regions of the data lines DL and the scan lines. Each of the pixels PX may include an organic light emitting diode, a driving element, switching elements, and a storage capacitor. For example, the switching element may be a thin film transistor (TFT). The pixels PX of the display panel 110 may display an image data.

The timing controller 120 may convert a first image data IMG1 provided from an external device to a second image data IMG2 and generate a data control signal CTL_D and a scan control signal CTL_S that control the second image data IMG2. The timing controller 120 may convert the first image data IMG1 to the second image data IMG 2 by applying an algorithm (e.g., dynamic capacitance compensation (DCC)) that compensates display quality to the first image data IMG 1. When the timing controller 120 does not include the algorithm that compensates for the display quality, the timing controller 120 may output the first image data IMG 1 as the second image data IMG 2. The timing controller 120 may receive the control signal CON from the external device and generate the data control signal CTL_D provided to the data driver 140 and the scan control signal CTL_S provided to the scan driver 130. For example, the data control signal CTL_D may include a horizontal start signal and at least one clock signals. For example, the scan control signal CTL_S may include a vertical start signal and at least one clock signals.

The scan driver 130 may provide scan signals SCAN1, SCAN2 to the pixels PX through the scan lines SL1, SL2. The scan driver 130 may generate the scan signals SCAN1, SCAN2 based on the scan control signal CTL_S provided from the timing controller 120. For example, the scan driver 130 may generate a first scan signal SCAN1 provided to the pixel PX through the first scan line SL1 and a second scan signal SCAN2 provided to the pixel PX through the second scan line SL2. The scan driver 130 may further generate a third scan signal SCAN3 provided to the pixel through the third scan line SL3.

The data driver 140 may generate a data voltage Vdata1 based on the second image data IMG2 and the data control signal CTL_D. The data driver 140 may generate a grayscale voltage corresponding to the second image data IMG2 as the data voltage Vdata1. The data driver 140 may provide the data voltage Vdata1 to the compensation circuit 150.

The compensation circuit 150 may sense a driving current Id flowing through the pixels PX and generate a compensation data voltage Vdata2 that compensates for a threshold voltage of the driving element based on the data voltage Vdata1 and the driving current Id.

Referring to FIG. 2, the compensation circuit 150 may be respectively coupled to the data lines DL and sensing lines L_sen of the display panel 110. In some example embodiments, each of a plurality of compensation circuits 150 may correspond to each of the data lines DL of the display panel 110. Each compensation circuit 150 may include a sensing unit 152 and a compensation data voltage generator (or compensation data generator or compensation voltage generator) 154. The sensing unit 152 may sense the driving current Id of the pixel PX through the sensing line L_sen and generate a sensing voltage corresponding to the driving current Id. The sensing unit 152 may be coupled to each of the pixels PX. The sensing unit 152 may sequentially sense the driving current Id of the pixels PX. For example, the sensing unit 152 may include a sensing resistor and an amplifier. The sensing unit 152 may provide sensing voltage corresponding to the driving current Id to the compensation data voltage generator 154. The compensation data voltage generator 154 may generate the compensation data voltage Vdata2 that compensates for the threshold voltage of the driving element based on the data voltage Vdata1 and the sensing voltage. For example, the compensation data voltage generator 154 may include a comparator. The compensation data voltage generator 154 may provide the compensation data voltage Vdata2 to the pixels PX through the data line DL.

Although the compensation circuit 150 coupled to the data driver 140 is described in FIG. 1, the compensation circuit 150 is not limited thereto. For example, the compensation circuit 150 may be located in the data driver 140.

As described above, the display device 100 of FIG. 1 may prevent the driving current Id from changing due to the threshold voltage of the driving element by sensing the driving current Id flowing through the pixels PX, generating the compensation data voltage Vdata2 that compensates for the threshold voltage of the driving element based on the data voltage Vdata1 and the driving current Id, and providing the compensation data voltage Vdata2 to the pixels PX. Thus, the display quality of the display device 100 may improve.

Figure 3:
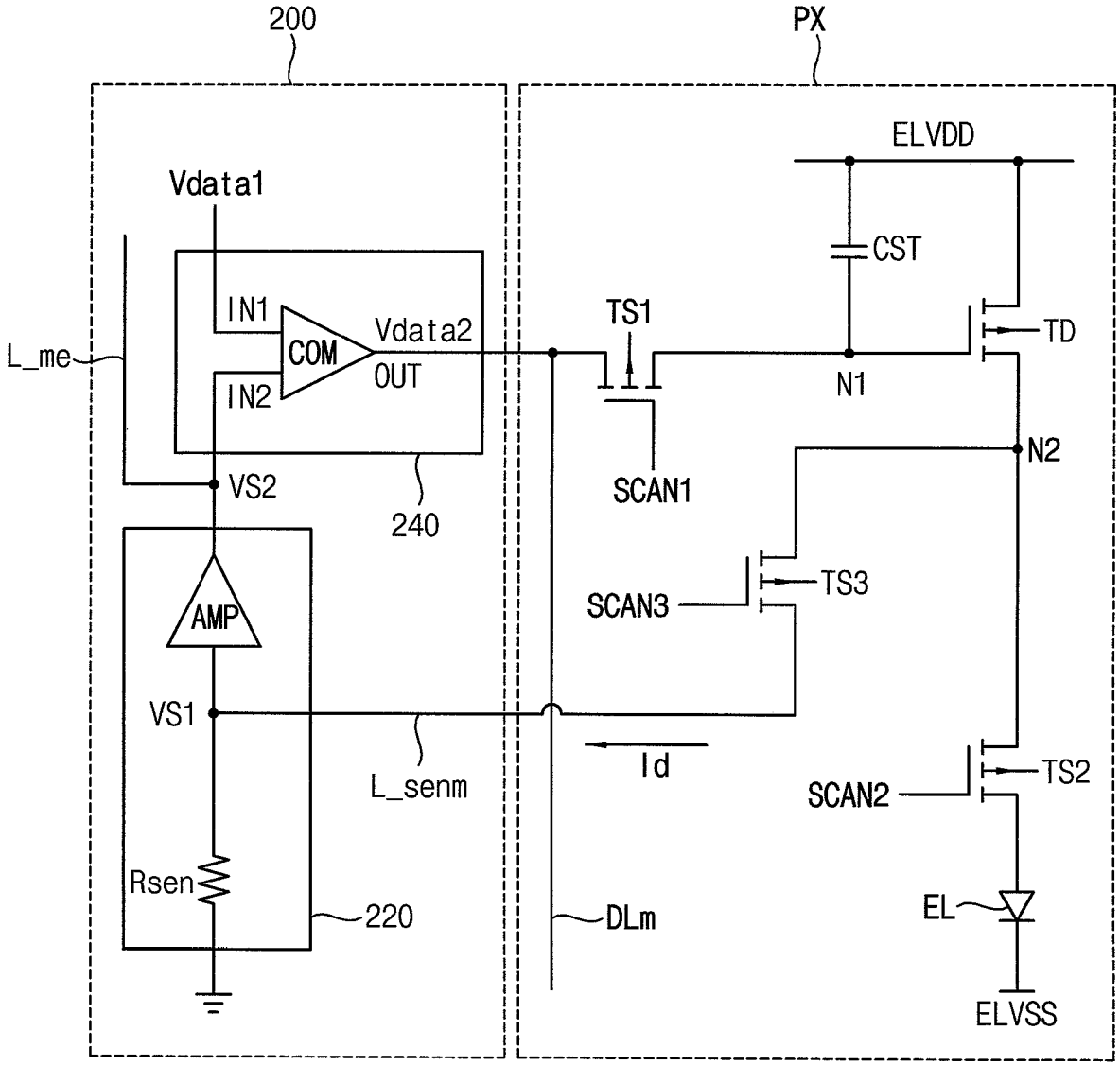
FIG. 3 is a circuit diagram illustrating an example of the compensation circuit and the pixel of FIG. 2.
Figure 4:
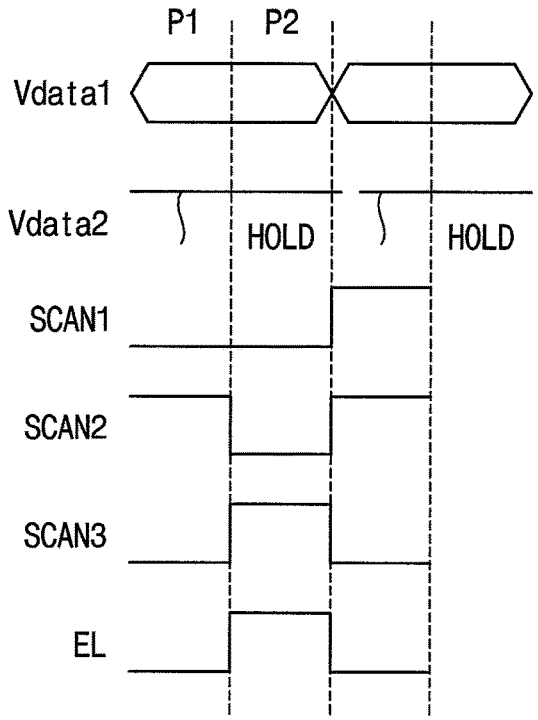
FIG. 4 is a timing diagram illustrating an example of an operation of the pixel of FIG. 3.
Figure 5:
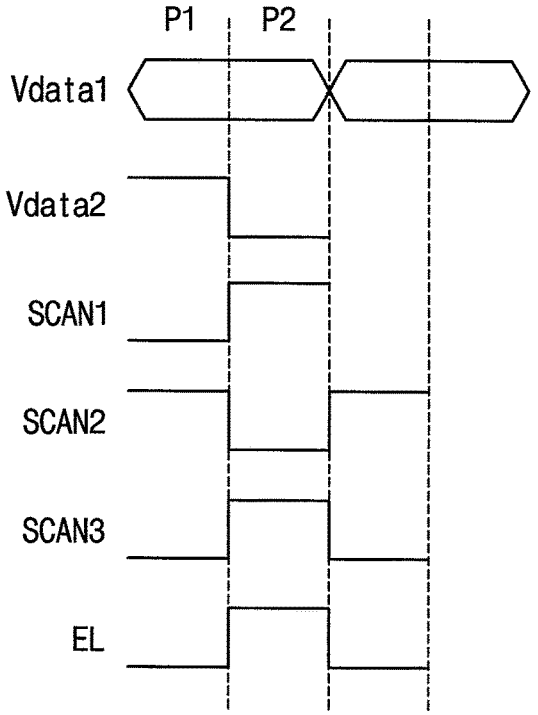
FIG. 5 is a timing diagram illustrating an example of an operation of the pixel of FIG. 3.

FIG. 3 is a circuit diagram illustrating an example of the compensation circuit and the pixel of FIG. 2 according to some example embodiments. FIG. 4 is a timing diagram illustrating an example of an operation of the pixel of FIG. 3. FIG. 5 is a timing diagram illustrating an example of an operation of the pixel of FIG. 3.

Referring to FIG. 3, a compensation circuit 200 may be coupled to the pixel PX. The compensation circuit 200 of FIG. 3 may correspond to the compensation circuit 150 of FIGS. 1 and 2. The compensation circuit 200 described in FIG. 3 may be coupled to an Mth data line DLm and the Mth sensing line L_senm. The pixel PX described in FIG. 3 may be one of the pixels coupled to the Mth data line DLm and the Mth sensing line L_senm.

Referring to FIG. 3, the pixel PX may include a driving element TD, a first switching element TS1, a second switching element TS2, a third switching element TS3, a storage capacitor CST, and an organic light emitting diode EL. For example, the driving element TD, the first switching element TS1, the second switching element TS2, and the third switching element TS3 may be P-channel metal oxide semiconductor (PMOS) transistors.

The driving element TD may include a gate electrode, a first electrode, and a second electrode. The driving element TD may include the gate electrode coupled to a first node N1, the first electrode that receives a first power voltage ELVDD, and the second electrode coupled to a second node N2. For example, the first power voltage ELVDD may be a high power voltage. The driving element TD may generate the driving current Id corresponding to the voltage applied to the first node N1.

The first switching element TS1 may include a gate electrode that receives the first scan signal SCAN1, a first electrode coupled to the data line DLm, and a second electrode coupled to the first node N1. When the first switching element TS1 is the PMOS transistor, the first switching element TS1 may turn on in response to the first scan signal SCAN1 having low level. When the first switching element TS1 turns on, the compensation data voltage Vdata2 provided through the data line DLm may be provided to the first node N1.

The second switching element TS2 may include a gate electrode that receives the second scan signal SCAN2, a first electrode coupled to the second node N2, and a second electrode coupled to an anode electrode of the organic light emitting diode EL. When the second switching element TS2 is the PMOS transistor, the second switching element TS2 may turn on in response to the second scan signal SCAN2 having the low level. When the second switching element TS2 turns on, the driving current Id generated in the driving element TD may be provided to the organic light emitting diode EL and the organic light emitting diode EL may emit light.

The third switching element TS3 may include a gate electrode that receives the third scan signal SCAN3, a first electrode coupled to the second node N2, and a second electrode coupled to the compensation circuit 200. When the third switching element TS3 is the PMOS transistor, the third switching element TS3 may turn on in response to the third scan signal SCAN3 having the low level. When the third switching element TS3 turns on, the driving current Id may be provided to the compensation circuit 200 through the third switching element TS3 and the sensing line L_senm.

The storage capacitor CST may include a first electrode that receives the first power voltage ELVDD and a second electrode coupled to the first node N1. The storage capacitor CST may store a voltage applied to the first node N1.

Although aspects of the pixel PX including the driving element TD, the first switching element TS1, the second switching element TS2, and the third switching element TS3 implemented as the PMOS transistors are described in FIG. 3, the driving element TD, the first switching element TS1, the second switching element TS2, and the third switching element TS3 are not limited thereto. For example, the driving element TD, the first switching element TS1, the second switching element TS2, and the third switching element TS3 may be implemented as N-channel metal oxide semiconductor (NMOS) transistors.

The compensation circuit 200 may include a sensing unit 220 and the compensation data voltage generator 240. The sensing unit 220 and the compensation data voltage generator 240 of FIG. 3 may be correspond to the sensing unit 152 and the compensation data voltage generator 154 of FIG. 2. The sensing unit 220 may include a sensing resistor Rsen and an amplifier AMP. The sensing resistor Rsen may generate a first sensing voltage VS1 corresponding to the driving current Id provided through the sensing line L_senm. The amplifier AMP may output a second sensing voltage VS2 by amplifying the first sensing voltage VS1 generated by the sensing resistor Rsen and removing noise. The second sensing voltage VS2 may be provided to the compensation data voltage generator 240. The compensation data voltage generator 240 may include a comparator COM. The comparator COM may compare the data voltage Vdata1 to the second sensing voltage VS2 and convert the data voltage Vdata1 to the compensation data voltage Vdata2. The comparator COM may include a first input terminal IN1 that receives the data voltage Vdata1, a second input terminal IN2 that receives the second sensing voltage VS2, and an output terminal OUT that outputs the compensation data voltage Vdata2 by comparing the data voltage Vdata1 and the second sensing voltage VS2.

The second sensing voltage VS2 may be a voltage corresponding to the reduced driving current Id generated by the driving element TD of which threshold voltage is changed by the degradation. The comparator COM may output the compensation data voltage Vdata2 that compensates for a difference between the data voltage Vdata1 provided from the data driver and the second sensing voltage VS2 provided from the sensing unit 220. That is, the compensation data voltage Vdata2 may have a voltage level that compensates for the reduced driving current Id due to the change in the threshold voltage of the driving element TD. The output terminal OUT of the comparator COM may be coupled to the data line DLm and provide the compensation data voltage Vdata2 to the first electrode of the first switching element TS1 included in the pixel PX. Although the compensation data voltage generator 240 that includes the comparator COM is described in FIG. 3, the compensation data voltage generator 240 may not be limited thereto. For example, the compensation data voltage generator 240 may further include a calculator that calculates the difference of the data voltage Vdata1 and the second sensing voltage VS2.

In some example embodiments, the compensation circuit 200 may further include a memory sensing line L_me. The memory sensing line L_me may be coupled to an output terminal of the amplifier AMP and sense the second sensing voltage VS2. For example, the memory sensing line L_me may be coupled to a memory device of the data driver and store the second sensing voltage VS2 corresponding to the driving current Id. In this case, the data driver may generate the data voltage Vdata1 that compensates for the threshold voltage of the driving element TD based on the second sensing voltage VS2 stored in the memory device. In this case, the compensation data voltage generator 240 may be omitted.

Referring to FIG. 4, the compensation circuit 200 may sense the driving current Id of the pixel PX during a compensation period P1. The first scan signal SCAN1 and the third scan signal SCAN3 having the low level, and the second scan signal SCAN2 having a high level may be provided to the pixel during the compensation period P1. The first switching element TS1 may turn on in response to the first scan signal SCAN1, the third switching element TS3 may turn on in response to the third scan signal SCAN3, and the second switching element TS2 may turn off in response to the second scan signal SCAN2. The data voltage Vdata1 provided through the data line DLm may be provided to the first node N1 because the first switching element TS1 turns on. The driving element TD may generate the driving current Id corresponding to the voltage of the first node N1. Here, the driving current Id may be reduced by the change in the threshold voltage of the driving element TD due to the degradation.

The compensation circuit 200 may sense the driving current Id through the sensing line L_senm because the third switching element TS3 turns on. The compensation circuit 200 may generate the driving current Id to the first sensing voltage VS2 using the sensing resistor Rsen. The compensation circuit 200 may output the first sensing voltage VS1 as the second sensing voltage VS2 using the amplifier AMP.

The amplifier AMP may output the second sensing voltage VS2 by amplifying the first sensing voltage VS1 and removing the noise. The compensation circuit 200 may compare the data voltage Vdata1 to the second sensing voltage VS2 and output the compensation data voltage Vdata2 that compensates for the threshold voltage of the driving element TD.

The compensation circuit 200 may continuously provide the compensation data voltage Vdata2 during an emission period P2. The first scan signal SCAN1 and the second scan signal SCAN2 having the low level, and the third scan signal SCAN3 having the high level may be provided to the pixel PX during the emission period P2. The first switching element TS1 may turn on in response to the first scan signal SCAN1, the second switching element TS2 may turn on in response to the second scan signal SCAN2, and the third switching element TS3 may turn off in response to the third scan signal SCAN3.

The compensation data voltage Vdata2 may be provided to the first node N1 through the data line DLm coupled to the output terminal OUT of the comparator COM because the first switching element TS1 turns on. The driving element TD may generate the driving current Id corresponding to the voltage of the first node N1. The organic light emitting diode EL may emit light based on the driving current Id because the second switching element TS2 turns on.

Although the timing diagram in which the compensation period P1 and the emission period P2 are sequentially ordered is described in FIG. 4, the timing diagram of the pixel PX is not limited thereto. For example, the timing diagram further includes an initialization period during which the driving element TD and the organic light emitting diode EL are initialized, a data writing period during which the data voltage Vdata1 is written in the storage capacitor CST, etc., arranged between the compensation period P1 and the emission period P2. Further, the compensation period P1 may be repeated at a cycle (e.g., a predetermined cycle).

Referring to FIG. 5, the compensation circuit 200 may sense the driving current Id of the pixel PX during the compensation period P1. The first scan signal SCAN1 and the third scan signal SCAN3 having the low level, and the second scan signal SCAN2 having a high level may be provided to the pixel during the compensation period P1. The first switching element TS1 may turn on in response to the first scan signal SCAN1, the third switching element TS3 may turn on in response to the third scan signal SCAN3, and the second switching element TS2 may turn off in response to the second scan signal SCAN2.

The data voltage Vdata1 provided through the data line DLm may be provided to the first node N1 because the first switching element TS1 turns on. The driving element TD may generate the driving current Id corresponding to the voltage of the first node N1. Here, the driving current Id may be reduced by the change in the threshold voltage of the driving element TD due to the degradation. The compensation circuit 200 may sense the driving current Id through the sensing line L_senm because the third switching element TS3 turns on. The compensation circuit 200 may generate the driving current Id to the first sensing voltage VS2 using the sensing resistor Rsen. The compensation circuit 200 may output the first sensing voltage VS1 as the second sensing voltage VS2 using the amplifier AMP. The compensation circuit 200 may compare the data voltage Vdata1 to the second sensing voltage VS2 and output the compensation data voltage Vdata2 that compensates for the threshold voltage of the driving element TD. The compensation data voltage Vdata2 may be provided to the pixel PX through the data line DLm. The compensation data voltage Vdata2 may be provided to the first node N1 and stored in the storage capacitor CST because the first switching element TS1 turns on during the compensation period P1.

The second scan signal SCAN2 having the low level, the first scan signal SCAN1 and the third scan signal SCAN3 having the high level may be provided to the pixel PX during the emission period P2. The second switching element TS2 may turn on in response to the second scan signal SCAN2, the first switching element TS1 may turn off in response to the first scan signal SCAN1, and the third switching element TS3 may turn off in response to the third scan signal SCAN3. The driving element TD may generate the driving current Id corresponding to the voltage stored in the storage capacitor CST. The organic light emitting diode EL may emit light based on the driving current Id because the second switching element TS2 turns on.

Although the timing diagram in which the compensation period P1 and the emission period P2 are sequentially ordered is described in FIG. 5, the timing diagram of the pixel PX is not limited thereto. For example, the timing diagram further includes an initialization period during which the driving element TD and the organic light emitting diode EL are initialized, a data writing period during which the data voltage Vdata1 is written in the storage capacitor CST, etc., arranged between the compensation period P1 and the emission period P2. Further, the compensation period P1 may be repeated at a cycle (e.g., a predetermined cycle).

Figure 6:
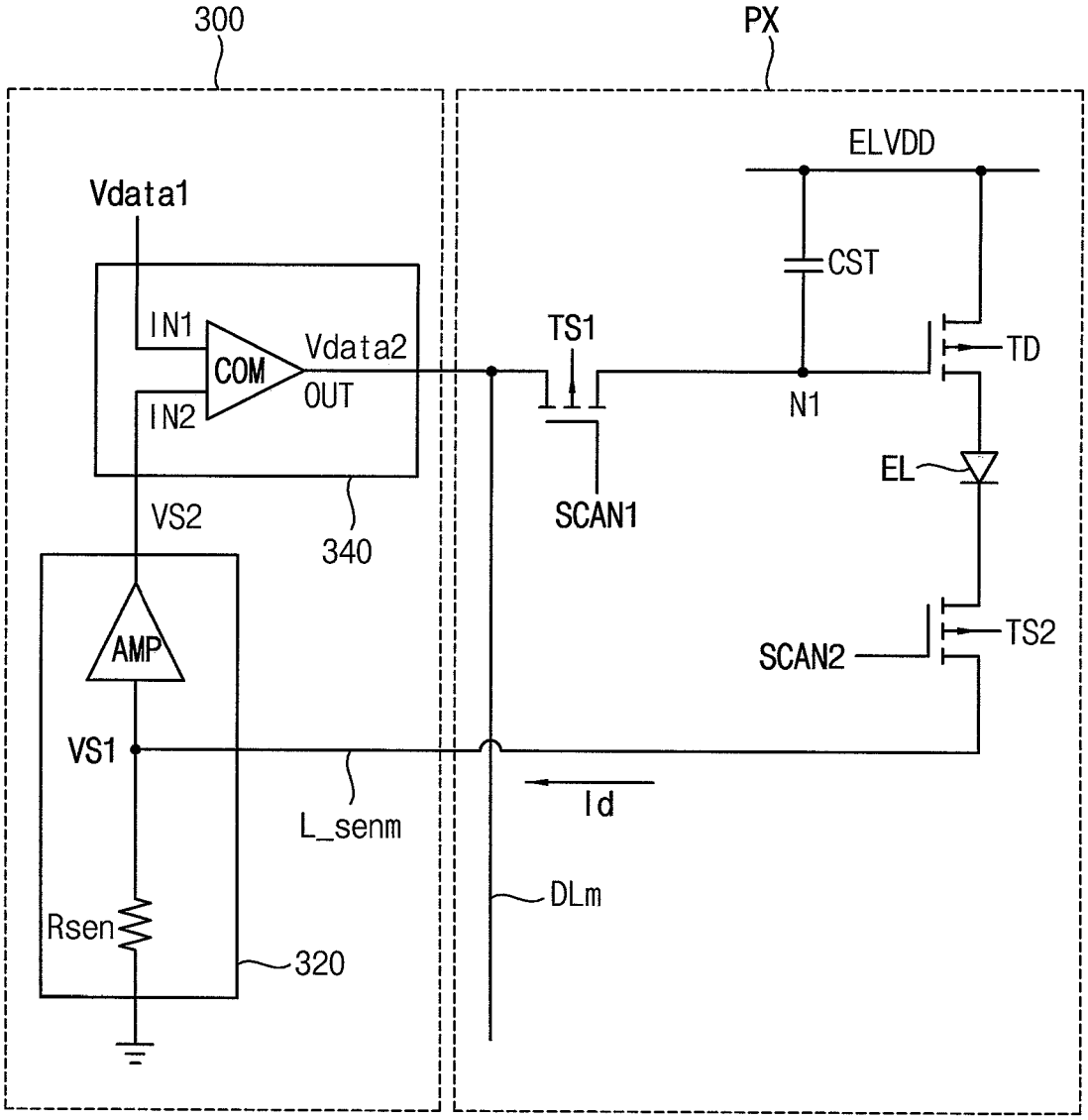
FIG. 6 is a circuit diagram illustrating an example of the compensation circuit and the pixel of FIG. 2.

FIG. 6 is a circuit diagram illustrating an example of the compensation circuit and the pixel of FIG. 2.

Referring to FIG. 6, a compensation circuit 300 may be coupled to the pixel PX. The compensation circuit 300 of FIG. 6 may correspond to the compensation circuit 150 of FIGS. 1 and 2. The compensation circuit 300 described in FIG. 6 may be coupled to an Mth data line DLm and the Mth sensing line L_senm. The pixel PX described in FIG. 6 may be one of the pixels coupled to the Mth data line DLm and the Mth sensing line L_senm.

Referring to FIG. 6, the pixel PX may include a driving element TD, a first switching element TS1, a second switching element TS2, a storage capacitor CST, and an organic light emitting diode EL. For example, the driving element TD, the first switching element TS1, and the second switching element TS2 may be the PMOS transistors.

The driving element TD may include a gate electrode, a first electrode, and a second electrode. The driving element TD may include the gate electrode coupled to a first node N1, the first electrode that receives a first power voltage ELVDD, and the second electrode coupled to a second node N2. For example, the first power voltage ELVDD may be a high power voltage. The driving element TD may generate the driving current Id corresponding to the voltage applied to the first node N1.

The first switching element TS1 may include a gate electrode that receives the first scan signal SCAN1, a first electrode coupled to the data line DLm, and a second electrode coupled to the first node N1. When the first switching element TS1 is the PMOS transistor, the first switching element TS1 may turn on in response to the first scan signal SCAN1 having low level. When the first switching element TS1 turns on, the compensation data voltage Vdata2 provided through the data line DLm may be provided to the first node N1.

The second switching element TS2 may include a gate electrode that receives the second scan signal SCAN2, a first electrode coupled to a cathode electrode of the organic light emitting diode EL, and a second electrode coupled to the compensation circuit 300. When the second switching element TS2 is the PMOS transistor, the second switching element TS2 may turn on in response to the second scan signal SCAN2 having the low level. When the second switching element TS2 turns on, the driving current Id flowing through the organic light emitting diode EL may be provided to the compensation circuit 300 through the second switching element TS2 and the sensing line L_senm.

Although the pixel PX including the driving element TD, the first switching element TS1, and the second switching element TS2 implemented as the PMOS transistors is described in FIG. 6, the driving element TD, the first switching element TS1, and the second switching element TS2 are not limited thereto. For example, the driving element TD, the first switching element TS1, and the second switching element TS2 may be implemented as the N-channel metal oxide semiconductor (NMOS) transistors.

The compensation circuit 300 may include a sensing unit 320 and the compensation data voltage generator 340. The sensing unit 320 and the compensation data voltage generator 340 of FIG. 6 may correspond to the sensing unit 152 and the compensation data voltage generator 154 of FIG. 2. The sensing unit 320 may include a sensing resistor Rsen and an amplifier AMP. The sensing resistor Rsen may generate a first sensing voltage VS1 corresponding to the driving current Id provided through the sensing line L_senm. The amplifier AMP may output a second sensing voltage VS2 by amplifying the first sensing voltage VS1 generated by the sensing resistor Rsen.

The second sensing voltage VS2 may be provided to the compensation data voltage generator 340. The compensation data voltage generator 340 may include a comparator COM. The comparator COM may compare the data voltage Vdata1 to the second sensing voltage VS2 and convert the data voltage Vdata1 to the compensation data voltage Vdata2. The comparator COM may include a first input terminal IN1 that receives the data voltage Vdata1, a second input terminal IN2 that receives the second sensing voltage VS2, and an output terminal OUT that outputs the compensation data voltage Vdata2 by comparing the data voltage Vdata1 and the second sensing voltage VS2.

The second sensing voltage VS2 may be a voltage corresponding to the reduced driving current Id generated by the driving element TD of which threshold voltage is changed by the degradation. The comparator COM may output the compensation data voltage Vdata2 that compensates for a difference between the data voltage Vdata1 provided from the data driver and the second sensing voltage VS2 provided from the sensing unit 320. That is, the compensation data voltage Vdata2 may have a voltage level that compensates for the reduced driving current Id due to the change in the threshold voltage of the driving element TD. The output terminal OUT of the comparator COM may be coupled to the data line DLm and provide the compensation data voltage Vdata2 to the first electrode of the first switching element TS1 included in the pixel PX. Although the compensation data voltage generator 340 that includes the comparator COM is described in FIG. 6, the compensation data voltage generator 340 may not be limited thereto. For example, the compensation data voltage generator 340 may further include a calculator that calculates the difference of the data voltage Vdata1 and the second sensing voltage VS2.

Figure 7:
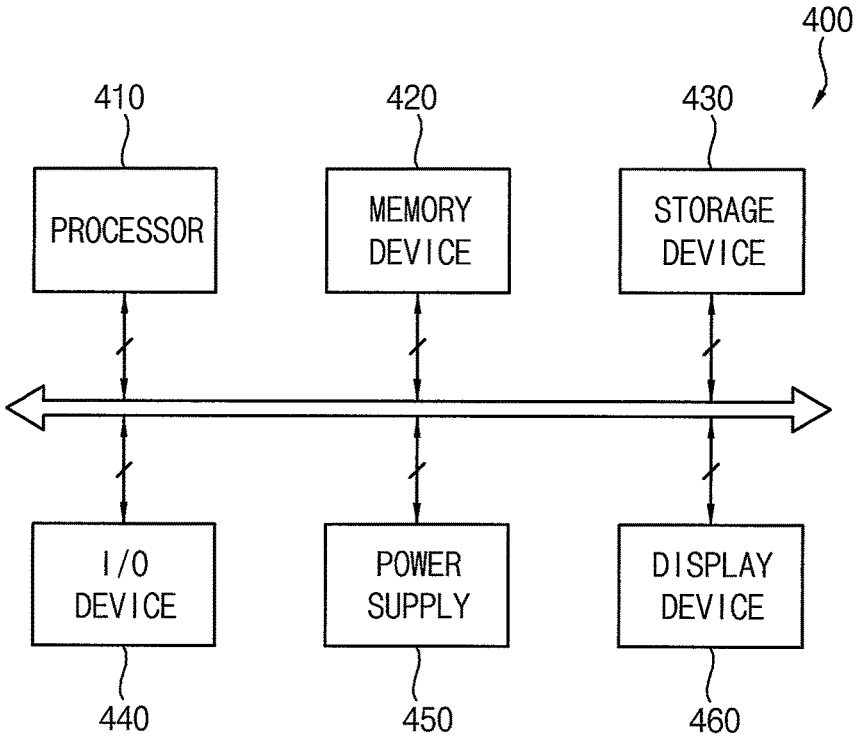
FIG. 7 is a block diagram illustrating an electronic device according to some example embodiments.
Figure 8:
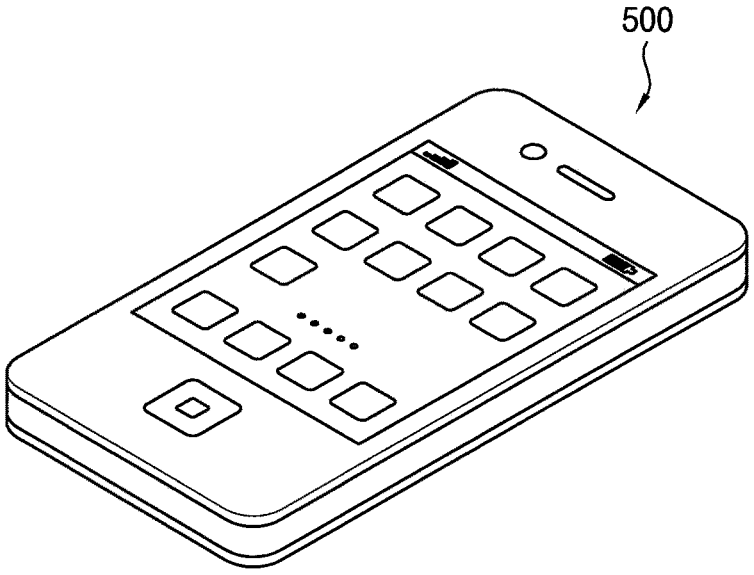
FIG. 8 is a diagram illustrating an example embodiment in which the electronic device of FIG. 7 is implemented as a smart phone.

FIG. 7 is a block diagram illustrating an electronic device according to some example embodiments. FIG. 8 is a diagram illustrating an example embodiment in which the electronic device of FIG. 7 is implemented as a smart phone.

Referring to FIGS. 7 and 8, an electronic device 400 may include a processor 410, a memory device 420, a storage device 430, an input/output (I/O) device 440, a power device 450, and a display device 460. Here, the display device 460 may correspond to the display device 100 of FIG. 1. In addition, the electronic device 400 may further include a plurality of ports for communicating a video card, a sound card, a memory card, a universal serial bus (USB) device, other electronic device, etc. Although it is illustrated in FIG. 8 that the electronic device 400 is implemented as a smart phone 500, a kind of the electronic device 400 is not limited thereto.

The processor 410 may perform various computing functions. The processor 410 may be a microprocessor, a central processing unit (CPU), etc. The processor 410 may be coupled to other components via an address bus, a control bus, a data bus, etc. Further, the processor 410 may be coupled to an extended bus such as surrounded component interconnect (PCI) bus. The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 430 may be a solid stage drive (SSD) device, a hard disk drive (HDD) device, a CD-ROM device, etc.

The I/O device 440 may be an input device such as a keyboard, a keypad, a touchpad, a touch-screen, a mouse, etc., and an output device such as a printer, a speaker, etc. In some example embodiments, the display device 460 may be included in the I/O device 440. The power device 450 may provide a power for operations of the electronic device 400. The display device 460 may communicate with other components via the buses or other communication links. As described above, the display device 460 may include may include a display panel, a timing controller, a scan driver, a data driver, and a compensation circuit.

The display panel may include a plurality of pixels that includes an organic light emitting diode and a driving element. The display panel may include a plurality of scan lines and a plurality of data lines. Each of the pixels may be electrically coupled to the scan lines and the data lines. In some example embodiments, a first scan line and a second scan line may be formed in the display panel. In other example embodiments, the first scan line, the second scan line, and a third scan line may be formed in the display panel. The timing controller may convert a first image data provided from an external device to a second image data.

The timing controller may generate a data control signal and a scan control signal that controls a driving of the second image data based on a control signal provided from the external device. The scan driver may provide a scan signal to the pixels through the scan lines. For example, the scan driver may generate a first scan signal provided to the pixel through the first scan line and a second scan signal provided to the pixel through the second scan line. The scan driver may further generate a third scan signal provided to the pixel through the third scan line. The data driver may generate a data voltage based on the second image data and the data control signal. The compensation circuit may sense a driving current flowing through the pixels and generate a compensation data voltage that compensates for a threshold voltage of the driving element based on the data voltage and the driving current. The compensation circuit may be respectively coupled to the data lines and sensing lines.

In some example embodiments, the pixel may include a driving element, a first switching element, a second switching element, a third switching element, a storage capacitor, and an organic light emitting diode. Each compensation circuit may include a sensing unit and a compensation data voltage generator. The sensing unit may sense the driving current of the pixel through the sensing line and generate a sensing voltage corresponding to the driving current. For example, the sensing unit may include a sensing resistor and an amplifier. The sensing resistor may generate a first sensing voltage corresponding to the driving current provided through the third switching element and the sensing line of the pixel. The amplifier may generate a second sensing voltage by amplifying the first sensing voltage generated by the sensing resistor. The second sensing voltage may be provided to the compensation data generator. The compensation data voltage generator may generate the compensation data voltage that compensates for a threshold voltage of the driving element based on the data voltage and the sensing voltage. For example, the compensation data voltage generator may include a comparator. The comparator may compare the data voltage to the second sensing voltage and convert the data voltage to the compensation data voltage.

In other example embodiments, the pixel may include a driving element, a first switching element, a second switching element, a storage capacitor, and an organic light emitting diode. Each of the compensation circuit may include a sensing unit and a compensation data voltage generator. The sensing unit may sense the driving current of the pixel through the sensing line and generate a sensing voltage corresponding to the driving current. For example, the sensing unit may include a sensing resistor and an amplifier.

The sensing resistor may generate a first sensing voltage corresponding to the driving current provided through the second switching element and the sensing line of the pixel. The amplifier may generate a second sensing voltage by amplifying the first sensing voltage generated by the sensing resistor. The second sensing voltage may be provided to the compensation data generator. The compensation data voltage generator may generate the compensation data voltage that compensates for a threshold voltage of the driving element based on the data voltage and the sensing voltage. For example, the compensation data voltage generator may include a comparator. The comparator may compare the data voltage to the second sensing voltage and convert the data voltage to the compensation data voltage.

As described above, the electronic device 400 according to some example embodiments may include the display device 460 that senses the driving current of the pixel and generates the compensation data voltage that compensates for a change of the driving current due to a threshold voltage of the driving element based on the driving current. Thus, display quality of the display device 460 may improve.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of aspects of some example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims, and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of pixels that each include an organic light emitting diode and a driving element, the display panel being configured to display an image data on the pixels;

a data driver configured to generate a data voltage corresponding to the image data;

a compensation circuit configured to sense a driving current flowing through the pixels and to generate a compensation data voltage that compensates for a threshold voltage of the driving element based on the data voltage and the driving current;

a scan driver configured to generate a first scan signal and a second scan signal provided to the pixels;

a timing controller configured to generate control signals that control the data driver and the scan driver, wherein the compensation circuit includes:

a sensing unit configured to sense the driving current and to generate a sensing voltage corresponding to the driving current; and a compensation voltage generator configured to generate the compensation data voltage that compensates for the threshold voltage of the driving element based on the data voltage and the sensing voltage.

2. The display device of claim 1, wherein the sensing unit includes:

a sensing resistor configured to sense the driving current and to generate a first sensing voltage corresponding to the driving current; and an amplifier configured to output a second sensing voltage by amplifying the first sensing voltage.

3. The display device of claim 2, wherein the compensation voltage generator includes a comparator that compares the data voltage to the second sensing voltage and converts the data voltage to the compensation data voltage.

4. The display device of claim 3, wherein the comparator includes:

a first input terminal configured to receive the data voltage;

a second input terminal configured to receive the second sensing voltage; and an output terminal configured to output the compensation data voltage by comparing the data voltage and the second sensing voltage.

5. The display device of claim 1, wherein the organic light emitting diode includes an anode electrode and a cathode electrode, and wherein the driving element includes a gate electrode coupled to a first node, a first electrode that receives a first power voltage, and a second electrode coupled to a second node.

6. The display device of claim 5, wherein the scan driver is further configured to generate a third scan signal provided to the pixels.

7. The display device of claim 6, wherein each of the pixels further includes:

a first switching element including a gate electrode configured to receive the first scan signal, a first electrode coupled to the compensation voltage generator, and a second electrode coupled to the first node;

a second switching element including a gate electrode configured to receive the second scan signal, a first electrode coupled to the second node, and a second electrode coupled to the anode electrode of the organic light emitting diode;

a third switching element including a gate electrode configured to receive the third scan signal, a first electrode coupled to the second node, and a second electrode coupled to the sensing unit; and a storage capacitor including a first electrode configured to receive the first power voltage and a second electrode coupled to the first node.

8. The display device of claim 7, wherein the first switching element and the third switching element are configured to turn on and the second switching element is configured to turn off in a compensation period of a pixel.

9. The display device of claim 7, wherein the first switching element and the second switching element are configured to turn on, the third switching element is configured to turn off, and the compensation data voltage is maintained in an emission period of a pixel.

10. The display device of claim 7, wherein the second switching element is configured to turn on, and the first switching element and the third switching element are configured to turn off in an emission period of a pixel.

11. The display device of claim 5, wherein each of the pixels further includes:

a first switching element including a gate electrode configured to receive the first scan signal, a first electrode coupled to the compensation voltage generator, and a second electrode coupled to the first node;

a second switching element including a gate electrode configured to receive the second scan signal, a first electrode coupled to the cathode electrode of the organic light emitting diode, and a second electrode coupled to the sensing unit; and a storage capacitor including a first electrode configured to receive the first power voltage and a second electrode coupled to the first node.

12. The display device of claim 11, wherein the second switching element is configured to turn on and the driving current is sensed in an emission period of a pixel.

13. The display device of claim 1, wherein the compensation circuit is located in the data driver or coupled to the data driver.

14. An electronic device including a display device and a processor that controls the display device, the display device comprising:

a display panel including a plurality of pixels that each include an organic light emitting diode and a driving element, the display panel being configured to display an image data on the pixels;

a data driver configured to generate a data voltage corresponding to the image data;

a compensation circuit configured to sense a driving current flowing through the pixels and to generate a compensation data voltage that compensates for a threshold voltage of the driving element based on the data voltage and the driving current;

a scan driver configured to generate a first scan signal and a second scan signal provided to the pixels; and a timing controller configured to generate control signals that control the data driver and the scan driver, wherein the compensation circuit includes:

a sensing unit configured to sense the driving current and to generate a sensing voltage corresponding to the driving current; and a compensation voltage generator configured to generate a compensation data voltage that compensates for the threshold voltage of the driving element based on the data voltage and the sensing voltage.

15. The electronic device of claim 14, wherein the sensing unit includes:

a sensing resistor configured to sense the driving current and to generate a first sensing voltage corresponding to the driving current; and an amplifier configured to output a second sensing voltage by amplifying the first sensing voltage, and wherein the compensation voltage generator includes a comparator configured to compare the data voltage to the second sensing voltage and to convert the data voltage to the compensation data voltage.

16. The electronic device of claim 14, wherein the organic light emitting diode includes an anode electrode and a cathode electrode, wherein the driving element includes a gate electrode coupled to a first node, a first electrode configured to receive a first power voltage and a second electrode coupled to a second node.

17. The electronic device of claim 16, wherein each of the pixels further includes:

a first switching element including a gate electrode configured to receive the first scan signal, a first electrode coupled to the compensation voltage generator, and a second electrode coupled to the first node;

a second switching element including a gate electrode configured to receive the second scan signal, a first electrode coupled to the second node, and a second electrode coupled to the anode electrode of the organic light emitting diode;

a third switching element including a gate electrode configured to receive a third scan signal, a first electrode coupled to the second node, and a second electrode coupled to the sensing unit; and a storage capacitor including a first electrode configured to receive the first power voltage and a second electrode coupled to the first node.

18. The electronic device of claim 16, wherein each of the pixels further includes:

a first switching element including a gate electrode configured to receive the first scan signal, a first electrode coupled to the compensation voltage generator, and a second electrode coupled to the first node;

a second switching element including a gate electrode configured to receive the second scan signal, a first electrode coupled to the cathode electrode of the organic light emitting diode, and a second electrode coupled to the sensing unit; and a storage capacitor including a first electrode configured to receive the first power voltage and a second electrode coupled to the first node.

* * * * *